US005287601A

United States Patent [19]

Schweitzer et al.

[11] Patent Number: 5,287,601

[45] Date of Patent: Feb. 22, 1994

[54] NOVELTY TIE

[75] Inventors: Erwin B. Schweitzer; Philip G. Simpfendorfer, both of Edithvale, Australia

[73] Assignee: It's Smart Pty Ltd, Victoria, Australia

[21] Appl. No.: 921,329

[22] Filed: Jul. 29, 1992

[51] Int. Cl.[5] ..... A43C 9/00

[52] U.S. Cl. ..... 24/715.3; 24/300

[58] Field of Search ..... 24/715.3, 715.4, 715.5, 24/715.6, 715.7, 300, 129 A, 129 D, 3 C, 3 M

[56] References Cited

U.S. PATENT DOCUMENTS

| | | | |
|---|---|---|---|
| 943,607 | 12/1909 | Schelling | 24/715.3 |
| 1,673,080 | 6/1928 | Lamy | 24/715.3 |
| 1,734,605 | 11/1929 | Smith | 24/129 A |
| 1,963,813 | 6/1934 | Van Voorhis | 24/715.3 |
| 2,306,515 | 12/1942 | Wright | 24/715.4 |
| 2,869,205 | 1/1959 | Kacowski | 24/715.3 |
| 2,994,300 | 8/1961 | Grahling | 24/300 |
| 4,423,539 | 1/1984 | Ivanhoe | 24/715.3 |
| 5,023,982 | 6/1991 | Mehan | 24/715.3 |

*Primary Examiner*—Victor N. Sakran

*Attorney, Agent, or Firm*—Dennison, Meserole, Pollack & Scheiner

[57] ABSTRACT

A flexible elasticized tie comprising a central flexible core enclosed within an outer braided textile covering, and two pairs of thin rubber cords secured to the tie by the outer braided covering and positioned on either side of a line extending helically of the core for the full length of the tie, said rubber cords being secured to the braided covering while in an extended state so that the tie maintains a generally helical form in its relaxed state.

11 Claims, 2 Drawing Sheets

NOVELTY TIE

FIELD OF THE INVENTION

This invention relates to functional and decorative ties, such as shoe laces, retaining ties for spectacles and sunglasses, and other ties for functional or decorative purposes.

BACKGROUND OF THE INVENTION

Shoe laces are usually formed from woven textile materials, with each end of the lace being restrained by a metal or plastics sleeve for preventing fraying of the ends of the lace. It has in the past been proposed to elasticize shoe laces to enable the lace to be tied on a shoe, the elasticized nature of the lace enabling the shoe to be removed without the need to undo the lace. While laces of this nature offer the advantage of facilitating removal of the shoe without the need to undo the laces, they still require the laces to be tied, and this may be difficult for young children or physically impaired persons. Furthermore, the laces do not provide any significant additional decorative aspect to the shoe.

SUMMARY OF INVENTION AND OBJECT

It is the object of the present invention to provide an improved elasticized tie which may be used as a shoe lace without the need for the lace to be tied, and which offers an additional decorative aspect when used as a shoe lace or as a tie for spectacles or sunglasses and in other fields.

The invention provides a flexible elasticized tie, comprising a central flexible core member, an outer covering substantially enclosing said core, and at least two spaced elastomeric members secured to the outer cover and/or to the core and extending in closely spaced substantially parallel relationship along a line extending helically of the tie for at least a substantial part of its length, said elastomeric members being secured to the tie in a stretched condition to cause the tie to adopt a generally helical form in its relaxed state while still allowing stretching of the tie from its helical state to an extended state in which the tie may be threaded through eyelets and the like.

It will be appreciated that since the tie adopts a generally helical form in its relaxed state, it will not pass through the eyelets of a shoe once it has been pulled through the eyelet to fix the shoe to the wearer, and the tie does not therefore require tying in the manner of a standard or elasticized shoe lace in order to function to retain the shoe on the wearer. Furthermore, since the tie still has elastic capacity when fitted to a shoe, it may be stretched for the purpose of removing the shoe from the wearer, without the need for the tie to be removed or released in any way. Furthermore, since the tie has a generally helical form, it adds a decorative effect to the particular chosen use.

In one preferred form of the invention, the central core is a woven cloth tube, which provides a flexible former on which the outer covering member is applied together with the elastomeric members.

The outer covering member is preferably woven or braided directly onto the flexible core member, and the elastomeric members are preferably attached to the outer covering member by being woven or braided into the outer covering member as it is woven or braided onto the flexible core member.

In a particularly preferred form of the invention, two closely spaced pairs of elastomeric members, such as thin rubber cords are secured in a closely spaced parallel arrangement along the line extending helically of the tie, preferably over its entire length.

Where the tie is to be used as a shoe lace, the ends of the tie are crimped within a metal or plastic sleeve enclosing a short end element of the tie at either end thereof.

BRIEF DESCRIPTION OF THE DRAWINGS

In order that the invention may be more readily understood, one preferred embodiment of the invention will now be described with reference to the accompanying drawings in which.

DESCRIPTION OF PREFERRED EMBODIMENT

Figure 1:
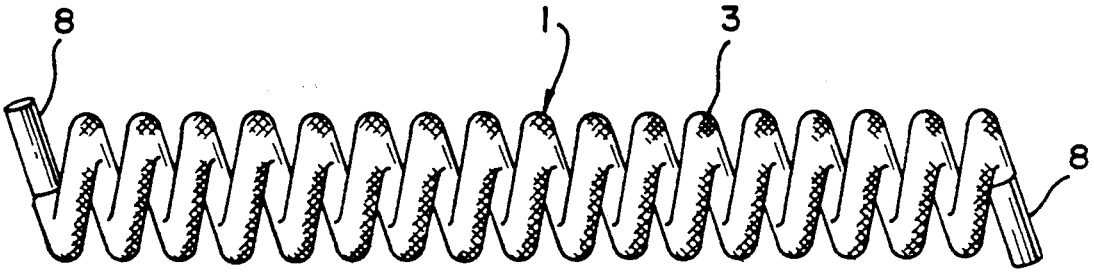
FIG. 1 is a plan view of a tie embodying the invention.
Figure 2:
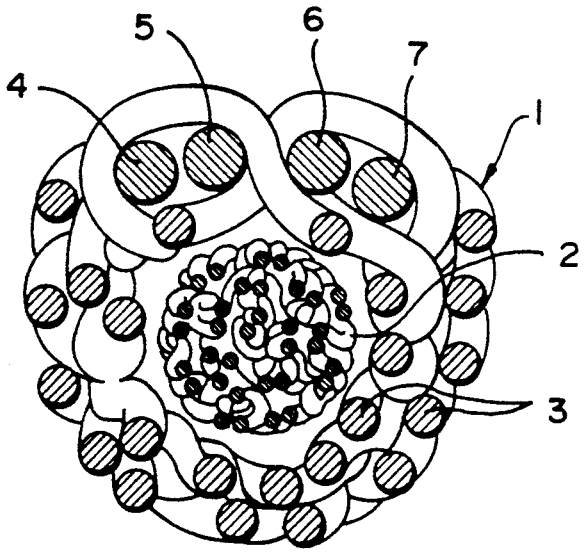
FIG. 2 is a schematic transverse section through the tie showing its construction.

Referring firstly to FIGS. 1 and 2 of the drawings, the tie embodying the invention is shown in the form of a shoe lace 1, comprising a central flexible core 2 in the form of a woven textile filler, made from any suitable material, such as nylon, which provides a generally cylindrical former on which the remainder of the tie 1 is formed. In the present embodiment, the core 2 is formed in a known manner as a braided tube on a known braiding machine.

The central flexible core member 2 has a braided textile outer covering 3 applied thereto by means of a known braiding machine. The braided covering 3 may be multicoloured and may be formed in any one of a multiplicity of designs. The core member 2 is fed into the braiding machine and the desired textile filaments are braided in a known manner around the core member 2.

Incorporated into the outer braided covering 3 are two pairs of thin rubber elasticizing cords 4, 5, 6 and 7 which extend helically of the core member 2 in a closely spaced parallel relationship to each other. The rubber cords 4 to 7 are therefore attached to the tie 1 by the braiding of the outer covering 3 onto the central core member 2 while they are held in an extended state sufficient to cause the tie 1 to maintain a generally helical form, as shown clearly in FIG. 1 of the drawings, in its relaxed state. At either end of the tie 1 a sleeve 8 of metal or plastic is applied to compress the tie to clamp the cords 4 to 7, to prevent fraying of the outer covering 3, and to provide a short straight section at either end of the tie for threading purposes.

The rubber cords 4 to 7 are in the present case made from latex based rubber, or from some synthetic equivalent, and are about 20 gauge in diameter. The cords are fed, along with the textile filaments, as they are braided around the core 2, through a rotating disc which causes the cords 4 to 7 to follows a helical path around the periphery of the core 2.

Figure 3:
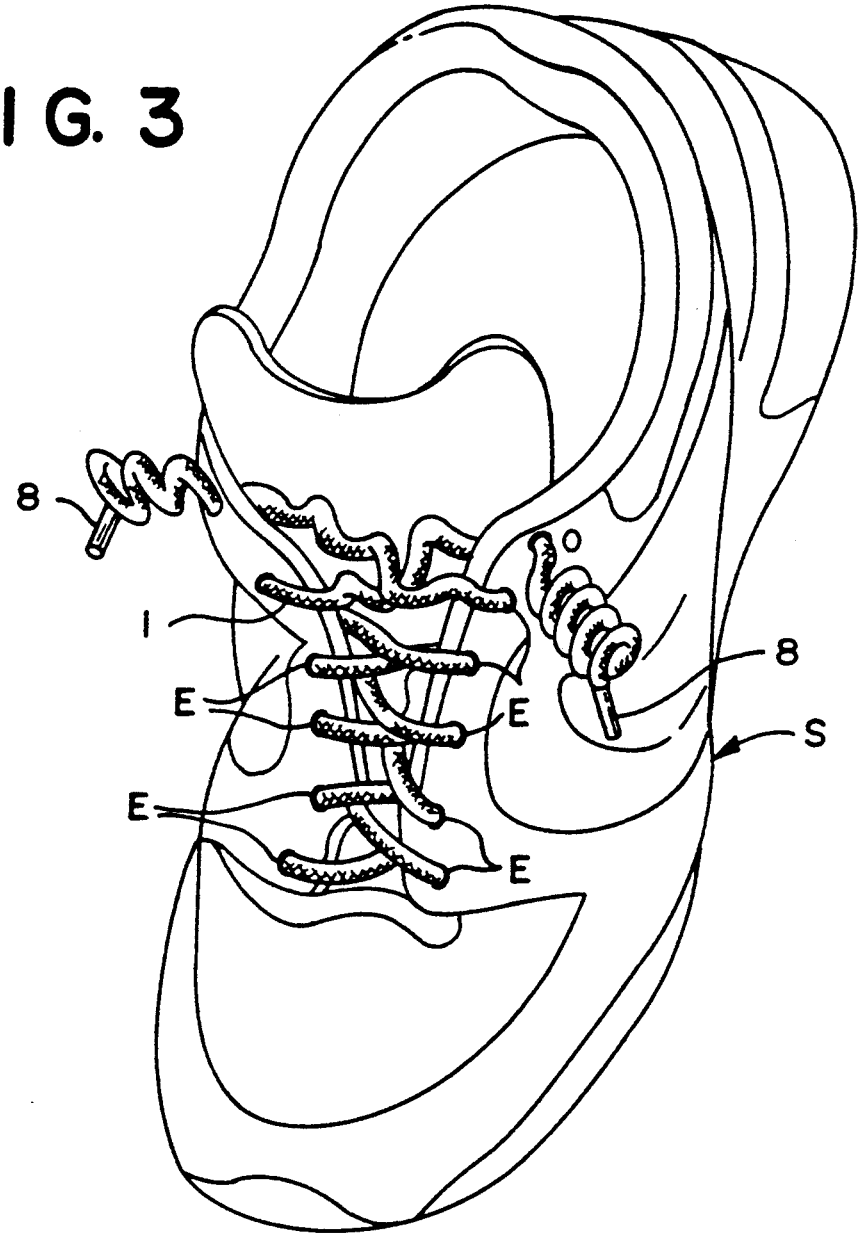
FIG. 3 is a perspective view of a shoe to which the tie has been fitted as a shoe lace.

By having two pairs of spaced parallel elasticizing cords 4 to 7 secured to the tie 1 in the braided covering 3, the tie is elasticized to a sufficient extent to maintain the helical form shown in FIG. 1 when in the relaxed state, while applying sufficient elasticizing force to the tie when fitted to a shoe to retain the shoe in its fitted position, but allowing the user to remove the shoe by stretching the tie without having to adjust or release the tie. Thus, as shown clearly in FIG. 3 of the drawings, the tie 1 is in use threaded through the lace eyelets E provided in the usual manner in the shoe S. As shown in FIG. 3, the shoe is able to be deformed sufficiently to release the shoe from the foot of the wearer without the need to release the tie 1 or adjust it to any significant extent.

It will be appreciated from FIG. 3 that the helical form of the tie does provide a decorative effect, when used as a shoe lace. The tie 1 is capable of being used as a retaining tie for spectacals or sunglasses, or for other functional or decorative tying purposes.

We claim:

1. A flexible elasticized tie comprising a central flexible core member, an outer cover enclosing said core member, and at least two spaced elastomeric members secured to at least one of said outer cover and said core member and extending in closely spaced substantially parallel relationship along a line extending helically of the tie for at least a substantial part of its length, said elastomeric members being secured in an elastomerically extended condition sufficient to cause the tie to adopt a generally helical form in its relaxed state while still allowing stretching of the tie from its helical state to an extended state whereby said tie is adapted for threading through eyelets and the like.

2. The flexible tie of claim 1, comprising two spaced pairs of said elastomeric members secured to at least one of said outer cover and to said core member.

3. The flexible tie of claim 1 or 2, wherein said outer cover comprises a braided textile layer braided directly over said central flexible core member, said elastomeric members being secured to said tie by said braided outer cover.

4. The flexible tie of claim 3, wherein said elastomeric members comprise thin rubber elements.

5. The flexible tie of claim 4, wherein said tie has opposed free ends constrained by short sleeves which serve to clamp the ends of the thin rubber elements.

6. The flexible tie of claim 1, wherein said elastomeric members comprise thin rubber elements.

7. The flexible tie of claim 1, wherein said tie has opposed free ends constrained by means of a short sleeve to define short straight end portions of said tie.

8. The flexible tie of claim 7, wherein said short sleeves serve to clamp the ends of the elastomeric members.

9. The flexible tie of claim 1 wherein said elastomeric members are capable of elastomerically stretching beyond said elastomerically extended securing condition for elastomeric extension of said tie beyond said extended state.

10. In a lace-secured item having opposed eyelets for the reception of distal portions of a tie, an elongate flexible elasticized tie having distal elongate portions each positionable through and beyond a respective eyelet, said tie including said distal portions being in a helically coiled configuration and elastically retained in such configuration and selectively generally linearly extendible therefrom, said distal portions in said helical configuration being dimensioned to preclude passage through said eyelets, said distal portions, when generally linearly extended, being dimensioned to pass through said eyelets, wherein said tie comprises a central flexible core member, an outer cover enclosing said core member, and elastomeric means secured to at least one of said outer cover and said core member and extending helically along said tie for at least a substantial part of its length, said elastomeric means being secured in an elastomerically extended condition sufficient to cause said tie to adopt said helically coiled configuration in its relaxed state while still allowing linear extension of said tie from its helical configuration to an extended state whereby said tie is adopted for threading through said eyelets.

11. The structure of claim 10 wherein said tie between said distal portions is elastomerically extendible and contractible independently of said end portions to allow for relative movement between said distal portions and said eyelets engaged thereby.

* * * * *